US005856658A

United States Patent [19]

Myung

[11] Patent Number: 5,856,658

[45] Date of Patent: Jan. 5, 1999

[54] POWER SUPPLY CUT-OFF APPARATUS OF MICROWAVE OVEN

[75] Inventor: Soon-Hwan Myung, Suwon, Rep. of Korea

[73] Assignee: Samsung Electronics Co., Ltd., Suwon, Rep. of Korea

[21] Appl. No.: 886,247

[22] Filed: Jul. 1, 1997

[51] Int. Cl.[6] ..... H05B 6/68

[52] U.S. Cl. ..... 219/723; 219/702; 219/715; 219/756

[58] Field of Search ..... 219/723, 722, 219/724, 756, 702, 715; 200/50.02, 50.14, 50.1, 50.08, 61.62, 61.76, 61.81

[56] References Cited

U.S. PATENT DOCUMENTS

| | | | |
|---|---|---|---|
| 3,691,329 | 9/1972 | Ball | 219/722 |
| 4,277,659 | 7/1981 | DeRemer | 200/61.62 |
| 4,321,445 | 3/1982 | Kristof et al. | 219/722 |
| 5,235,150 | 8/1993 | Buske et al. | 219/722 |

FOREIGN PATENT DOCUMENTS

| | | | |
|---|---|---|---|
| 52-37241 | 3/1977 | Japan | 219/723 |
| 55-56534 | 4/1980 | Japan | 219/722 |

*Primary Examiner*—Philip H. Leung
*Attorney, Agent, or Firm*—Burns, Doane, Swecker & Mathis, L.L.P.

[57] ABSTRACT

A microwave oven includes a safety mechanism which automatically cuts off a supply of electric power to the oven when a panel of the oven housing has been removed, even if the power supply cord is still plugged in. The safety mechanism includes a switch disposed on the housing for cutting off the power. A cover for the switch is movable between a first position covering the switch, and a second position exposing the switch. The switch is biased to a power-cut-off position and the cover is biased to the first position. A structure of the panel is arranged to automatically move the cover to its second position, as well as to move the switch to a power-supply position, in response to the panel being in an assembled state. When the panel is removed, the switch automatically cuts off the electric power, and the cover moves to the first position covering the switch.

7 Claims, 2 Drawing Sheets

POWER SUPPLY CUT-OFF APPARATUS OF MICROWAVE OVEN

BACKGROUND OF THE INVENTION

1. Field of the Invention

The present invention relates to a microwave oven and, in particular, to increasing the safety of workers performing repairs or maintenance thereon.

2. Description of the Prior Art

A conventional microwave oven, as illustrated in FIGS. 1 and 2, includes a cooking chamber 60 formed by a housing. The housing comprises various panels, including a front panel 20, a back panel 30, a base panel 40 and a removable outer panel 50. A turntable 70 is disposed on a floor of the cooking chamber 60. A door 80 is provided for opening and closing the cooking chamber 60, and a control unit 90 is provided for establishing cooking function modes or for operating a magnetron (not shown), or the like.

In order to drive the microwave over thus constructed, when a door-open button at the control unit 90 is pressed while an electric cord 100 is still plugged in an electrical outlet, the door 80 is opened to light a lamp in the cooking chamber 60.

At this time, food is placed on the turntable 70, the door 80 is closed, a desired cooking time and cooking menu and the like are input by way of the control unit 90, and a start button is pressed. Then the turntable 70 is rotated in one direction as a high frequency of 2,450 MHZ is generated according to an oscillating operation of a magnetron (not shown) to thereafter be dispersed in the cooking chamber 60.

The high frequency dispersed in the cooking chamber 60 is reflected from metal walls therein and is radiated to the food on the turntable 70 to thereby heat the food.

However, there is a problem in the conventional microwave oven thus constructed in that an electric shock to a worker can happen when the outer panel 50 is separated while the electric cord 100 is still plugged in the outlet during repair or maintenance of the product.

SUMMARY OF THE INVENTION

Accordingly, the present invention is provided to solve the aforementioned problem and it is an object of the present invention to provide a power supply cut-off apparatus for a microwave oven by which an input power supply can be automatically cut off to thereby prevent an electric shock to a worker even if the outer panel is separated while an electric cord is still plugged in an outlet during a repair of the product.

In accordance with the object of the present invention, there is provided a microwave oven comprising a housing formed by disconnectable panels, an electric cord for supplying electric power to the oven, a switch disposed on the housing and including a press button, the switch being operable to cut off electric power supplied from the cord when the button is not pressed, and a cover mounted on the housing and movable between a first position covering the button and a second position exposing the button, the cover being biased to the first position. One of the panels includes an actuating structure for moving the cover to the second position and for pressing the button, in response to the one panel being in an assembled state.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

Figure 1:
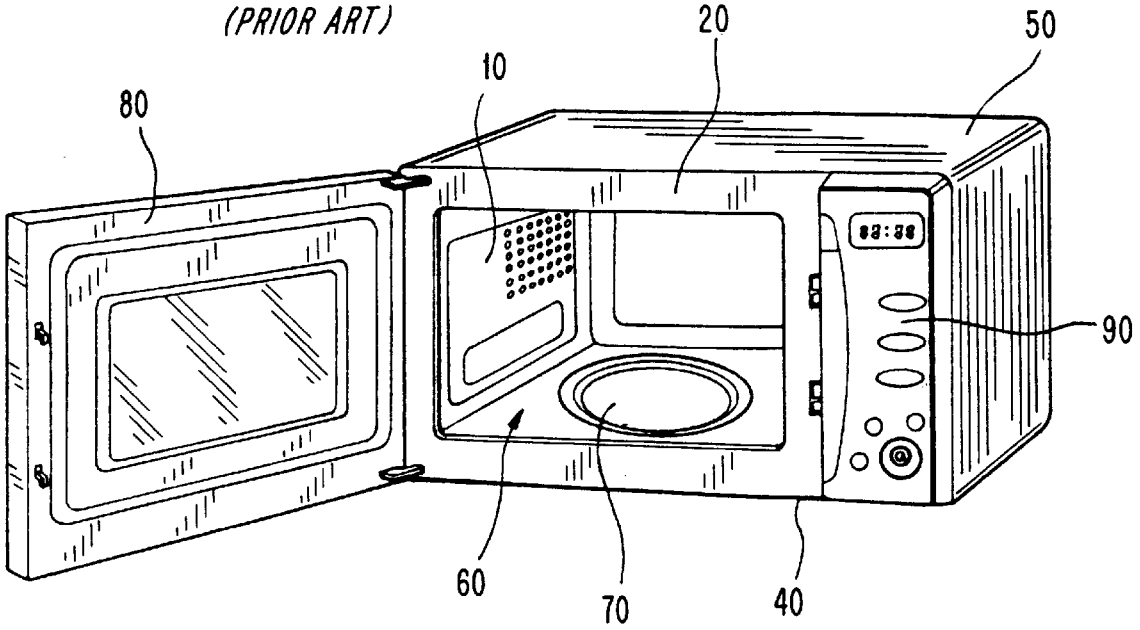
FIG. 1 (PRIOR ART)
FIG. 1 is a perspective view for illustrating a front surface of a microwave oven according to the prior art.
Figure 2:
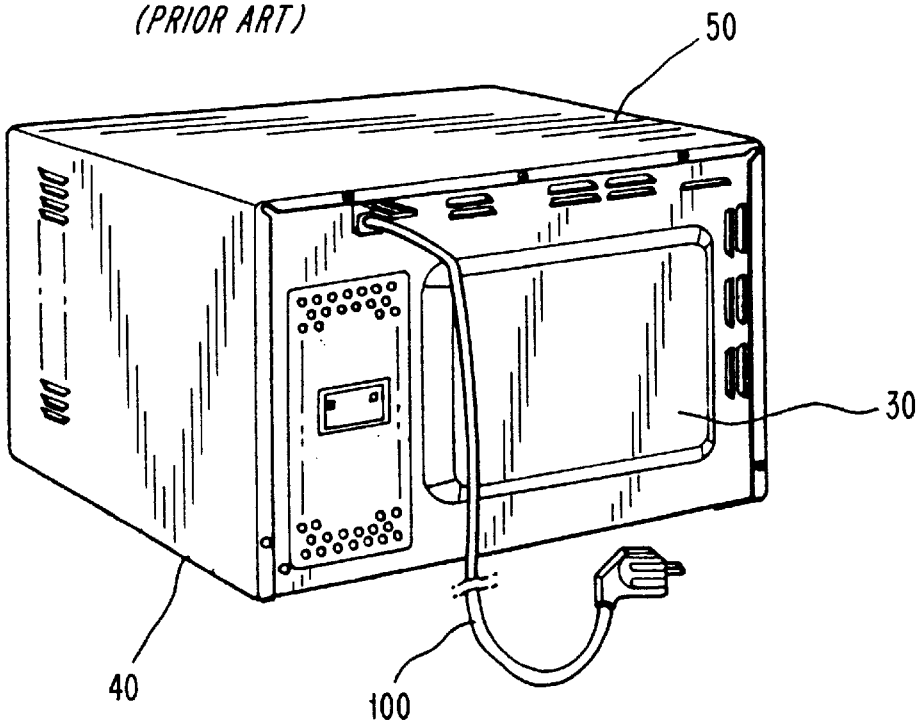
FIG. 2 (PRIOR ART)
FIG. 2 is a perspective view for illustrating a rear surface of a microwave oven according to the prior art.

An embodiment of the present invention will now be described in detail with reference to the accompanying drawings.

Throughout the drawings, like reference numerals and symbols are used for designation of like or equivalent parts or portions for simplicity of illustration and explanation.

Figure 3:
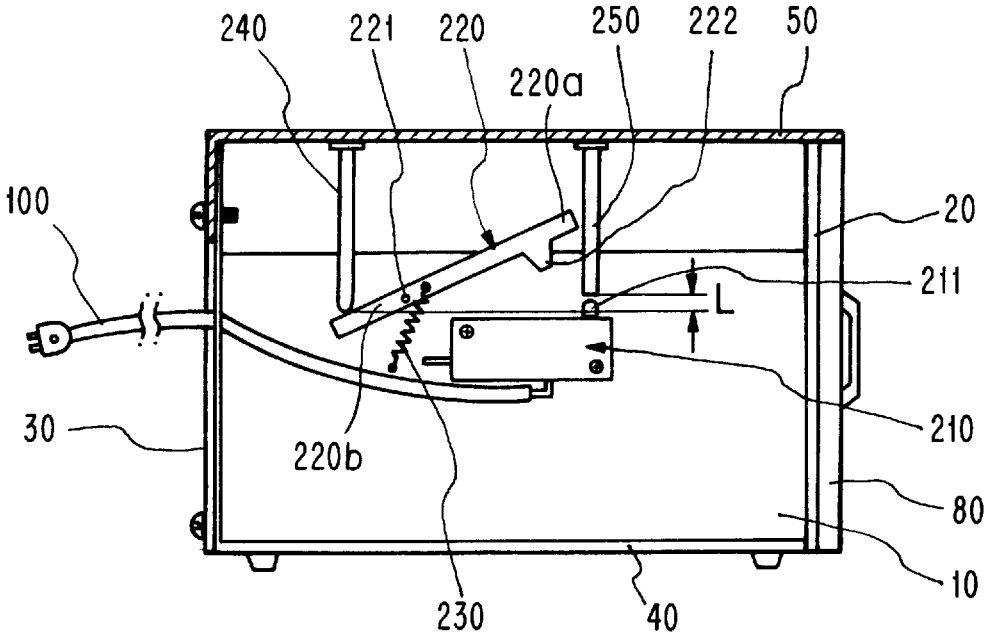
FIG. 3 is a side section view illustrating an assembled state of an outer panel according to the present invention.
Figure 4:
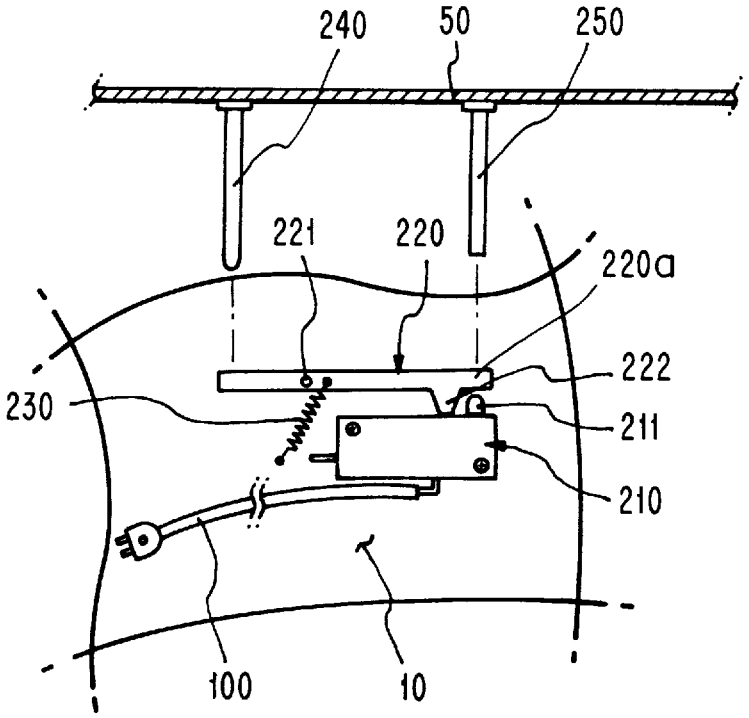
FIG. 4 is a side sectional view illustrating a separated state of an outer panel according to the present invention.

A power supply cut-off apparatus for a microwave oven of the type previously discussed includes, as illustrated in FIGS. 3 and 4, a main switch 210 disposed at one side of the main housing section 10 of the oven for being electrically connected to an electric cord 100 of the oven to thereby turn on or turn off a power supply in the microwave oven, a lever or cover 220 operable to cover or expose a press button 211 of the main switch 210 according to a seesaw operation. A spring 230 is connected between the lever 220 and the housing section 10 in order to cover the press button 211 when a tip end or covering portion 220*a* of the lever 220 is lowered by the resilient action of the spring. A lever pin 240 and a switch pin 250 (together defining an actuating structure) are disposed at a predetermined spacing on an inner ceiling surface of the outer panel 50 of the oven. The lever pin 24 functions to pivot the lever 220 to a button-exposing state when the outer panel 50 is assembled, to enable the switch pin to press the press button 211 and thereby turn on the main switch 210. Raising the pins 240, 250 serves to disconnect the press button 211 when the outer panel 50 is separated to thereby turn off the main switch 210.

Furthermore, the lever 220 includes a mounting portion 220*b* hinged to one side of the housing section 10 by a hinge axle 221.

The lever 220 is integrally formed underneath the tip end thereof with an interval-maintaining protruder 222, so that the tip end of the lever 220 can maintain a predetermined spacing above an upper surface of the main switch 210 when the lever 220 is horizontally positioned, to avoid contact with the press button 211. Thus, the cover 220 is blocked against movement for pressing the buttons.

The interval-maintaining protruder 222 is formed to be a little longer than the press button 211.

The lever pin 240 is, as illustrated in FIG. 3, vertically downwardly projecting from an inner ceiling surface of the outer panel 50 in order to engage a rear end of the lever 220 to lower that rear end and raise the tip end of the lever 220 when the outer panel 50 is lowered in the process of being coupled to the back panel 30.

The switch pin 250 is vertically downwardly projecting from the inner ceiling surface of the outer panel 50 at a predetermined interval from the lever pin 240 in order to turn on the main switch 210 by pressing the button 211 when the outer panel 50 is lowered in the process of being coupled to the back panel 30.

The lever pin 240 is longer by a length "L" than the switch pin 250 so that the lever pin 240 first contacts and pivots the lever 220 before the switch pin 250 pushes the button.

Next, the operation of the power cut-off apparatus of a microwave oven according to the embodiment of the present invention thus constructed will be described.

In order to repair the microwave oven which is in a state depicted in FIG. 3, first of all, a plurality of fastening screws (no reference numerals designated) positioned at a rear external marginal area of the outer panel 50 are removed to permit disassembly of the outer panel 50 from the back panel 30. The outer panel 50 is lifted as shown in FIG. 4 and the switch pin 250 is released from the press button 211 of the main switch 210 to turn off the main switch 210.

In other words, a movable contact disposed in the main switch 210 and connected to the press button 211 is released from a fixed contact by a spring (not shown) to thereby cut off the power supply applied to the microwave oven through the electric cord 100.

Thus, even though the repair is performed with the electric cord 100 still inserted in the outlet, the power supply is automatically cut off by the inactivated main switch 210, thereby preventing the application of an electrical shock to the worker.

Still furthermore, when the outer panel 50 is lifted upward, the lever pin 240 is released from a rear end of the lever 220, and the lever 220 is pivoted to a horizontal state by a resilient action of the spring 230, whereupon the interval maintaining protruder 222 contacts an upper surface of the main switch 210 to cause a tip end of the lever 220 to cover but not contact, the press button 211.

Next, when the repair is done and the outer panel 50 is lowered to assemble the product, the lever pin 240 contacts the rear end of the lever 240 to pivot the lever 220, and expose the press button 211, as illustrated in FIG. 3.

At this time, switch pin 250 presses the exposed button 211, to turn on the main switch 210 to cause the movable contact disposed within switch 210 to contact the, fixed contact and cause the power supply to be applied to the product through the electric cord 100.

Screw holes (no reference numerals designated) of the outer panel 50 and the back panel 30 are mutually aligned so that a worker can attach screws to fasten the outer panel 50 to the back panel 30.

As is apparent from the foregoing, there is an advantage in the power supply cut-off apparatus according to the invention in that a main switch is turned off during disassembly of the outer panel for repair of the microwave oven with an electric cord still inserted in an outlet to thereby cut off a power supply in the microwave oven. Also, the main switch is turned on by a pressing action when the outer panel is assembled to thereby supply the power supply to the microwave oven, thereby eliminating an electric shock which can happen during the repair work of the microwave oven.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A microwave oven comprising:

a housing including first and second disconnectable panels, the housing forming a cooking chamber;

a door mounted on the housing for opening and closing the cooking chamber;

an electric cord for supplying electric power to the oven;

a switch disposed on the first panel and including a press button, the switch being operable to cut off electric power supplied from the cord when the button is not pressed; and a cover including a mounting portion and a button-covering portion, the mounting portion mounting the cover on the first panel for movement between a first position wherein the button-covering portion covers the button, and a second position wherein the button-covering portion exposes the button, the button-covering portion arranged to move away from the button when moving to its second position, the cover being biased toward the first position;

the second panel including an actuating structure for moving the cover to the second position against the bias and for pressing the exposed button, in response to the second panel being assembled to the first panel;

the actuating structure including a button-pressing member movable in a direction toward the button for pressing the button, the button-covering portion being immovable in said direction when in its first position, whereby both the button-covering portion and the button-pressing member are prevented from pressing the button.

2. The microwave oven according to claim 1 wherein the button-pressing member comprises a first pin, the actuating structure further comprising a second pin arranged to move the cover to its second position.

3. The microwave over according to claim 2 wherein the first pin is arranged to contact and move the cover before the second pin reaches the button.

4. The microwave oven according to claim 1 wherein the cover comprises a lever pivotably mounted for movement between the first and second positions.

5. The microwave oven according to claim 4 wherein the cover includes a protruder engaging a surface for preventing the covering portion from moving in said direction when the cover is in its first position.

6. The microwave oven according to claim 1, further including a spring connected to the cover for biasing the cover to its first position.

7. The microwave oven according to claim 1 wherein the button-covering portion moves generally opposite said direction during a portion of the movement of the cover to its second position.

* * * * *